US006374650B1

(12) United States Patent
Newman

(10) Patent No.: US 6,374,650 B1
(45) Date of Patent: Apr. 23, 2002

(54) LOCK MECHANISM

(75) Inventor: Donald John Newman, Victoria (AU)

(73) Assignee: Lockwood Australia Pty Ltd. (AU)

( * ) Notice: Subject to any disclaimer, the term of this patent is extended or adjusted under 35 U.S.C. 154(b) by 0 days.

(21) Appl. No.: 09/402,440

(22) PCT Filed: Apr. 6, 1998

(86) PCT No.: PCT/AU98/00229

§ 371 Date: Oct. 7, 1999

§ 102(e) Date: Oct. 7, 1999

(87) PCT Pub. No.: WO98/45558

PCT Pub. Date: Oct. 15, 1998

(30) Foreign Application Priority Data

Apr. 8, 1997 (AU) ..... P06042

(51) Int. Cl.[7] ..... E05B 63/12

(52) U.S. Cl. ..... 70/131; 70/102; 70/142

(58) Field of Search ..... 10/129, 131, 142, 10/102, 134; 292/140, DIG. 41

(56) References Cited

U.S. PATENT DOCUMENTS

| | | | | | |
|---|---|---|---|---|---|
| 4,719,774 | A | * | 1/1988 | Newman et al. | 70/131 |
| 4,813,250 | A | * | 3/1989 | Yeh | 70/131 X |
| 4,918,953 | A | | 4/1990 | Newman | 70/131 |
| 5,044,181 | A | * | 9/1991 | Roop et al. | 70/131 |

FOREIGN PATENT DOCUMENTS

| | | |
|---|---|---|
| EP | 0270425 | 6/1988 |
| FR | 2551126 | 3/1985 |
| GB | 2274306 | 7/1994 |

* cited by examiner

*Primary Examiner*—Suzanne Dino Barrett
(74) *Attorney, Agent, or Firm*—Lerner, David, Littenberg, Krumholz & Mentlik, LLP

(57) ABSTRACT

The invention is concerned with a lock mechanism of the kind having a deadbolt (9) which is operable by either an inside actuator or an outside actuator. The inside actuator usually includes a turn knob or the like, and the outside actuator usually includes a key operated lock. The lock mechanism includes a gear train (8) through which each of the two actuators is drivably connected to the deadbolt (9). The gear train includes two drive gears (13, 14) which are independently rotatable about a common axis of rotation, and each is connected to a respective one of the two actuators so as to rotate in response to operation of that actuator. The gear train (8) also includes two driven gear (17, 18) which are united to form a single piece composite gear (16), and each driven gear (17, 18) is cooperable with a respective one of the two drive gears (13, 14). The composite gear (16) is connected to the deadbolt (9) so that the deadbolt (9) moves between operative and inoperative positions in response to rotation of the composite gear (16). Each actuator adopts a rest position when the deadbolt (9) is in the inoperative position, and neither drive gear (13, 14) cooperatively engages with the composite gear (16) when the respective actuator is in the rest position. Furthermore, the gear arrangement is such that the outside actuator turns through 360° to cause the deadbolt (9) to move from one of its positions to the other, whereas 180° rotation of the inside actuator is sufficient to effect the same degree of deadbolt movement

19 Claims, 5 Drawing Sheets

LOCK MECHANISM

FIELD OF THE INVENTION

This invention relates to lock mechanisms of the kind used with deadbolt assemblies intended to secure a movable member, such as a door, in a closed position at which it prevents access to a space at one side (usually the inside) of the door or other member. It will be convenient to hereinafter describe the invention with particular reference to doors, but it is to be understood that the invention has wider application.

BACKGROUND OF THE INVENTION

Deadbolt assemblies of the foregoing kind generally have two rotatable actuators which are operable at the inside and the outside of the door respectively. The outside actuator is usually in the form of a key operated lock, whereas the inside actuator usually includes a manually operable turn knob. It is desirable that the key operated lock at the outside of the assembly be arranged to turn through 360° in moving the deadbolt between operative and inoperative positions. The inside actuator however, may require less movement (e.g., 180° rotation) to achieve the same result, and the lock mechanism needs to permit the different movement requirements of the two actuators.

Various means have been adopted to address the foregoing problem. One lock mechanism which has proven to be particularly satisfactory is that disclosed by Australian Patent 601098, but that mechanism is relatively complicated. The prior mechanism is expensive to manufacture because it requires a large number of parts and is difficult to assemble by automatic means.

It is an object of the present invention to provide a deadbolt lock mechanism of relatively simple form which requires a minimum number of parts and which is relatively easy to assemble.

SUMMARY OF THE INVENTION

A lock mechanism in accordance with the present invention is characterised in that it includes a gear train through which each of the two actuators is drivably connected to the deadbolt. The gear train includes two drive gears which are rotatable independent of one another, at least to some extent, and each of which is adapted to be caused to rotate by a respective one of each of the two actuators. Each of the two drive gears is cooperable with a composite gear which also forms part of the gear train and which is drivably connected to the deadbolt so as to move the deadbolt between its operative and inoperative positions.

The arrangement is preferably such that the composite gear rotates through 180° in moving the deadbolt between its operative and inoperative conditions, and such 180° movement occurs regardless of which of the two actuators is operated. In particular, the 180° composite gear movement occurs when driven by the drive gear connected to the outside actuator even though that drive gear may rotate through 360°.

In a preferred arrangement, the composite gear includes two gears interconnected for simultaneous rotation about a common axis. The two gears may be formed integral or otherwise secured together for that purpose. It is further preferred that a drive member, such as a pin, is connected to the composite gear and cooperates with the deadbolt in a manner such that the deadbolt moves linearly in response to rotation of the composite gear.

The gear train and the deadbolt may be housed within a hollow casing, and in one arrangement it is preferred that the deadbolt cooperates with the casing so as to be guided along a straight path when moving between the operative and inoperative positions. The gear train is preferably arranged to be loaded, in sub-assembly form, into the casing through an open side of the casing. The loading operation can be performed automatically and has the effect of placing the composite gear in drivable engagement with the deadbolt. A removable cover plate may be attached to the casing to extend over the aforementioned open side and thereby retain the gear train in place.

Reference to "gear" throughout this specification is to be understood as embracing a rotatable member having teeth extending around part only of its periphery. That is, the word "gear" embraces any rotatable member having a gear-like function during at least part of a complete revolution of movement of that member about its axis of rotation.

BRIEF DESCRIPTION OF THE DRAWINGS

Embodiments of the invention are described in detail in the following passages of the specification which refer to the accompanying drawings. The drawings, however, are merely illustrative of how the-invention might be put into effect, so that the specific form and arrangement of the various features as shown is not to be understood as limiting on the invention.

In the drawings.

DETAILED DESCRIPTION

Figure 1:
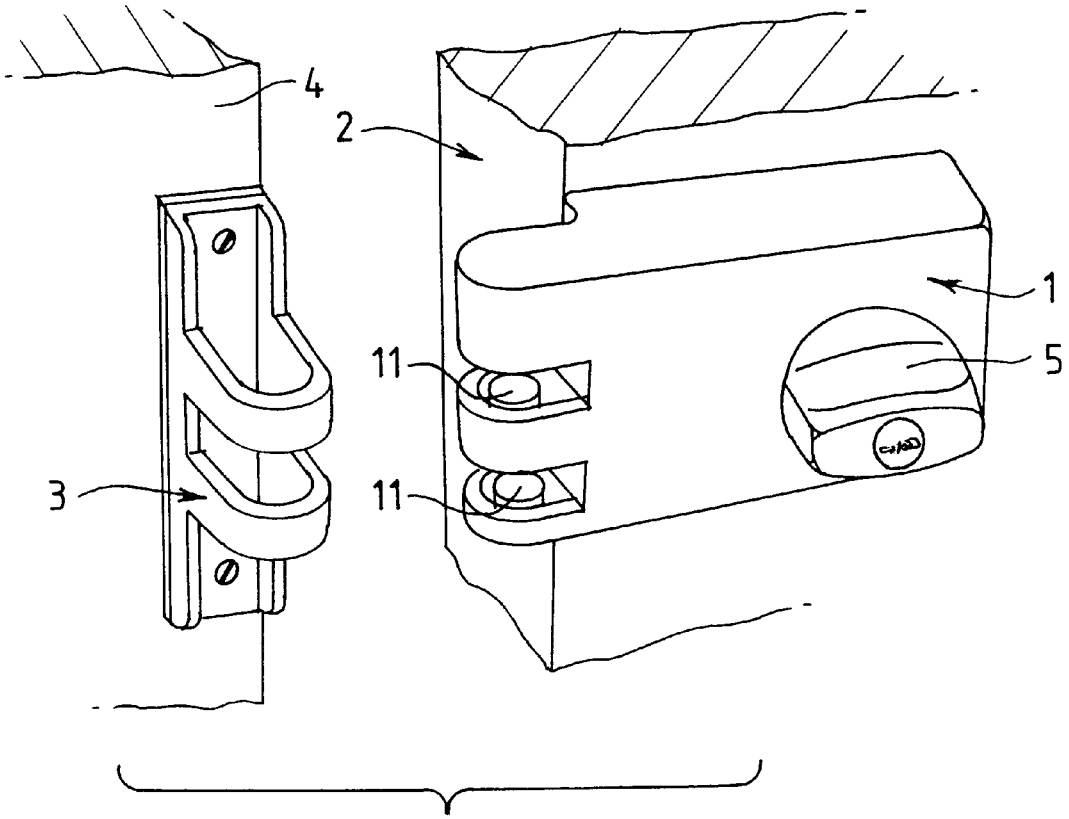
FIG. 1 is a perspective view of an example deadbolt assembly to which the invention can be applied.
Figure 2:
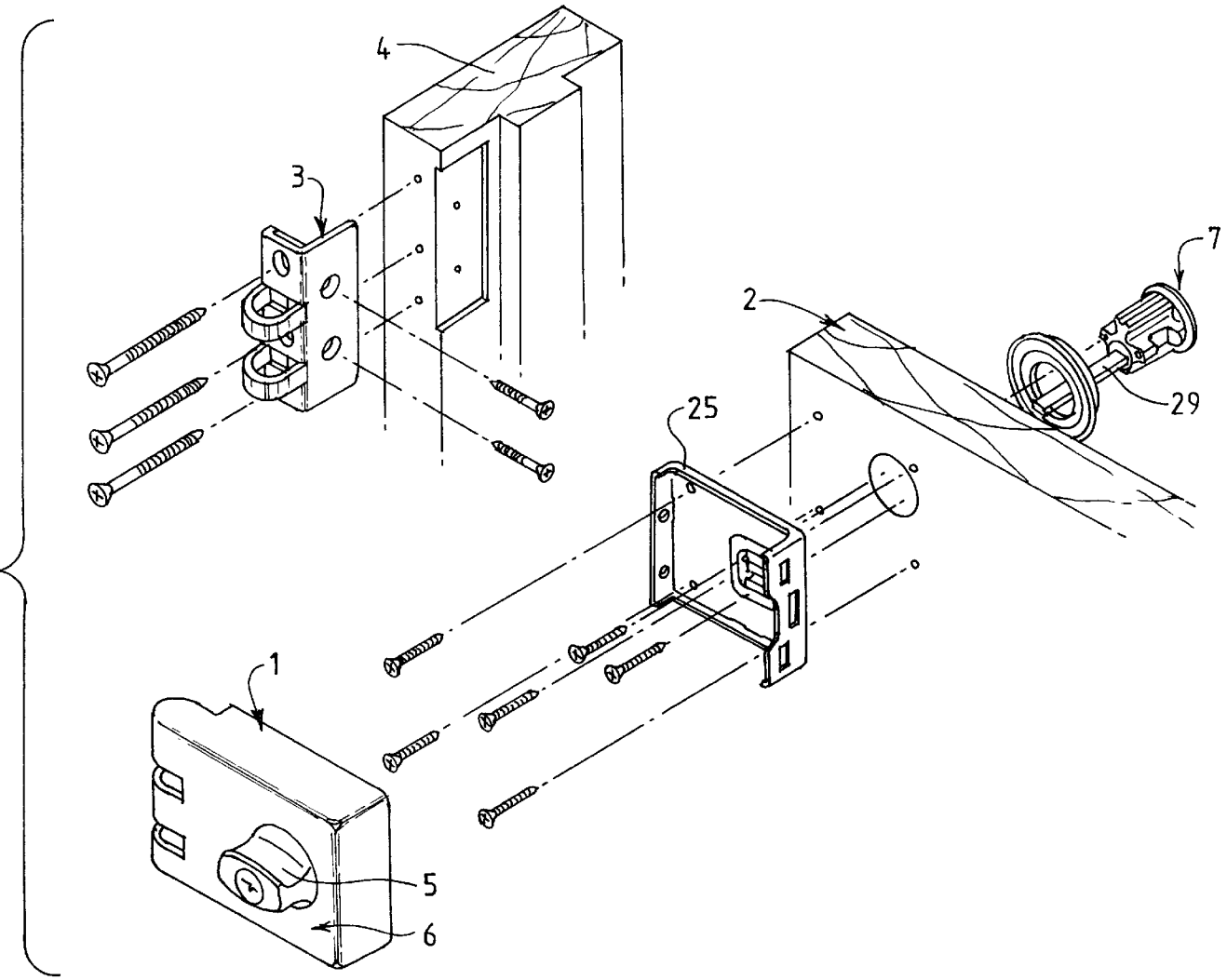
FIG. 2 is an exploded view of the assembly shown by FIG. 1.

FIG. 1 of the accompanying drawings shows one form of deadbolt assembly 1 to which the invention is applicable. The assembly 1 is shown secured to a door 2 and adapted to cooperate with a strike 3 secured to a door jamb 4. A turn knob 5 is rotatably mounted on a housing 6 and forms an inside actuator of the assembly 1. FIG. 2 is an exploded view of the arrangement shown by FIG. 1 and shows a key operated lock 7 which forms an outside actuator of the assembly 1. It is to be understood that the arrangement shown by FIGS. 1 and 2 is an example only and that the invention can be applied to other deadbolt arrangements. Also, the inside and outside actuators need not be of the type shown by FIGS. 1 and 2.

Figure 3:
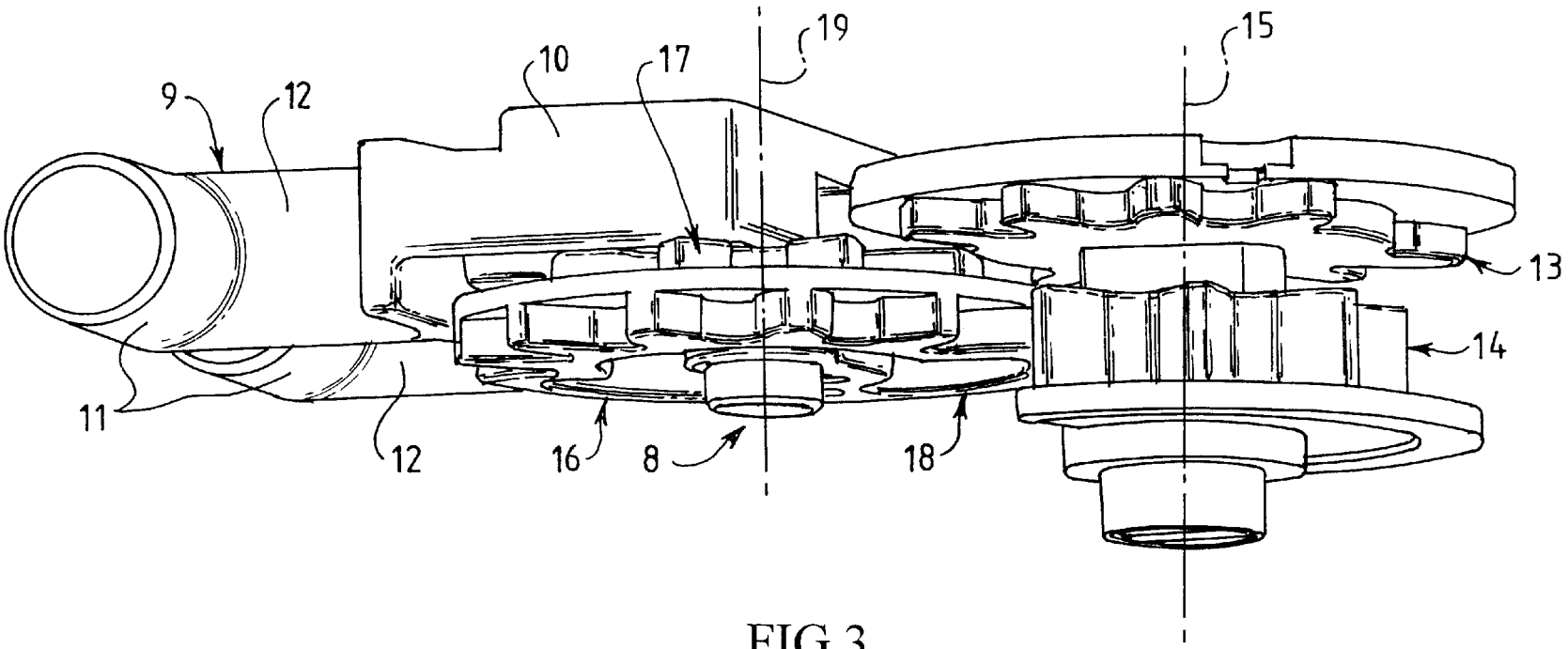
FIG. 3 is a perspective view of a gear train sub-assembly according to one embodiment of the invention.

A lock mechanism sub-assembly according to one embodiment of the invention is shown by FIG. 3. That sub-assembly includes a gear train 8 and a deadbolt 9 of the kind used in the arrangement of FIGS. 1 and 2. The deadbolt 9 includes a plate 10 and two cylindrical locking members 11, each of which is connected to the plate 10 through a respective connecting bar 12. Such deadbolts are well known. The invention is applicable to other types of deadbolts.

The gear train 8 includes two drive gears 13 and 14 arranged for rotation about a common axis 15, and each of those gears is capable of rotation relative to the other as hereinafter explained. The gear train 8 also includes a composite gear 16 which is cooperatively engageable with each of the drive gears 13 and 14 and includes two driven gear members 17 and 18 interconnected for rotation about a common axis 19. It is preferred that the two gear members 17 and 18 are formed integral.

In the particular arrangement shown, each of the drive gears 13 and 14 and each of the driven gear members 17 and 18 is a partial gear in that it does not have a single series of gear teeth extending completely around its circumference. As will be evident from FIG. 4, the drive gear 13 has two groups of gear teeth which are arranged in diametrically opposed relationship and which are separated by spaces 20 and 21. The drive gear 14 has a single group of teeth which extends partway around the periphery of the gear so that a gap exists between the opposite ends of that group of teeth. Each of the driven gear members 17 and 18 also has a single group of teeth extending partway around its periphery, and a blank or non-toothed section 22 and 23 respectively extends between the opposite ends of each of those groups of teeth. It is to be appreciated that arrangements other than that shown by FIG. 4 could be adopted.

Figure 4:
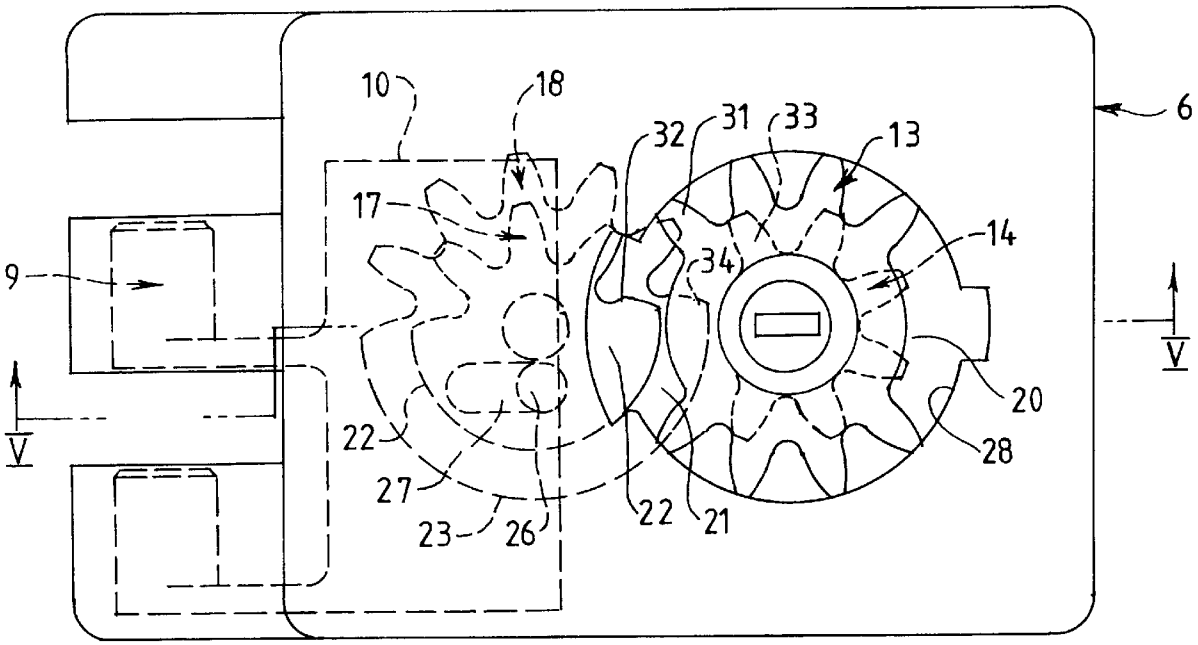
FIG. 4 is a plan view of a lock mechanism in accordance with one embodiment of invention which incorporates the sub-assembly of FIG. 3.
Figure 5:
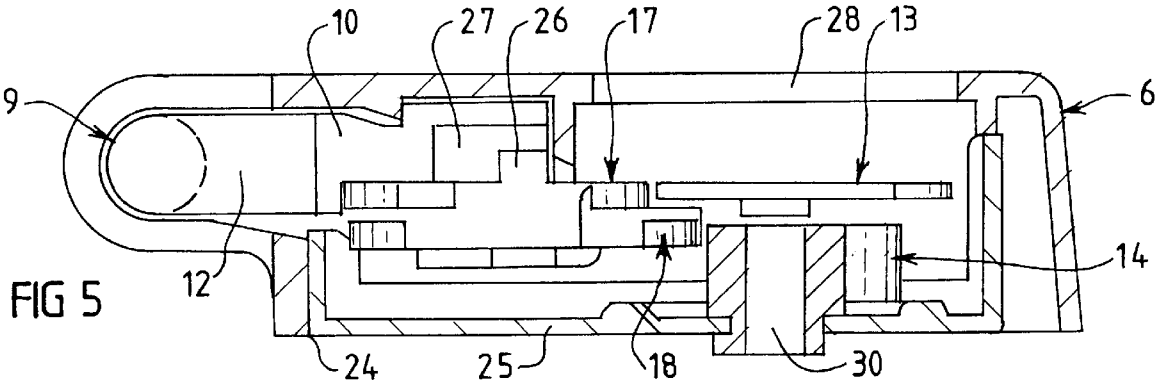
FIG. 5 is a cross-sectional view taken along line V—V of FIG. 4.

As best seen by FIGS. 4 and 5, both the deadbolt 9 and the gear train 8 are located within a hollow casing 6. The casing 6 and deadbolt 9 cooperate in a manner such that the deadbolt 9 is guided for linear movement between its operative and inoperative positions. The gear train 8 is loaded, in subassembly form, into the casing 6 by way of an open side 24 of the casing. The gear train 8, or part thereof, may be loaded into the casing 6 while attached to a cover plate 25 which closes the open side 24 of the casing 6 and which can be releasably secured to the casing 6 so as to thereby retain the gear train 8 in place.

A drive connection is made between the gear train 8 and the deadbolt 9, and that preferably occurs during the process of loading the gear train 8 into the casing 6. In the particular arrangement shown, the drive connection includes a pin 26 secured to the composite gear 16 at a location radially outwards of the axis of rotation of the composite gear 16, and a cooperable recess 27 formed in the deadbolt plate 10. As best seen in FIG. 5, the pin 26 projects beyond a face of the gear member 17 so as to locate within the recess 27, and as best seen in FIG. 4 the recess 27 is preferably in the form of a straight slot, which extends longitudinally in a direction transverse to the direction of movement of the deadbolt 9.

In a completed form of the assembly 1, the key operated lock 7 is drivably connected to the drive gear 14 and the turn knob 5 is mounted within the opening 28 (FIGS. 4 and 5) of the casing 6 so as to be drivably connected with the drive gear 13. Each of the two drivable connections may be of a known kind. For example, as shown by FIG. 2, the key operator lock 7 may be connected to the gear 14 through a non-circular drive bar 29 which locates within a substantially complementary passage 30 formed in the gear 14. A similar type of connection may be provided between the turn knob 5 and the gear 13.

As will be evident from FIG. 4, neither of the drive gears 13 and 14 cooperatively engages with the composite gear 16 when the respective drive gear 13 or 14 has the rotational position shown by FIG. 4. The relevant position of rotation of each of the gears 13 and 14 corresponds to a rest position of the respective actuator 5 or 7, and also corresponds to the inoperative position of the deadbolt 9.

When the turn knob 5 is rotated so as to move the gear 13 anti-clockwise from the position shown by FIG. 4, an end tooth 31 of the gear 13 engages against an abutment 32 at one end of the blank section 22 of the gear member 17. Because of that engagement the gear member 17 is moved clockwise thereby swinging the drive pin 26 through an arc such that it presses against the upper side of the slot 27. Because of the cooperation between the pin 26 and the slot 27 the deadbolt plate 10 is moved upwards so as to cause the deadbolt 9 to adopt the operative position. The teeth of the gear 13 and the gear member 17 respectively intermesh in the course of that movement, but those teeth become disengaged after approximately 180° rotation of the gear 13 because of the space 20 provided in the periphery of that gear. It will be apparent that reverse rotation of the gear 13 through 180° will restore the deadbolt 9 to the inoperative position as shown by FIG. 4.

If the key operated lock 7 is operated instead of the turn knob 5, anti-clockwise rotation of the drive gear 14 causes an end tooth 33 of that gear to engage an abutment 34 at one end of the blank section 23 of the driven gear member 18. As will be apparent from FIG. 4, there will be some delay before that engagement occurs and the teeth of the gear 14 and the gear member 18 respectively cooperatively mesh following that engagement. Because of the aforementioned delay and the different diameters of the gear 14 and the gear member 18 respectively, the gear member 18 rotates through 180° in response to 360° rotation of the gear 14. Movement of the deadbolt 9 occurs as in the case of operation of the turn knob 5 because the gear members 17 and 18 rotate in unison. That is, the pin 27 is swung through an arc of 180° regardless of whether the turn knob 5 or the key operated lock 7 is used to drive the composite gear 16.

In either mode of operation as described above (i.e., turn knob operation or key operated lock operation), rotation of either gear 13 or 14 does not cause rotation of the other gear 14 or 13 respectively. That is in spite of the fact that the two gear members 17 and 18 rotate in unison. As will be apparent from FIG. 4, the gear member 18 can move through 180° without causing rotation of the gear 14. Similarly, the gear member 17 can move through 180° without causing rotation of the gear 13. It is relevant in that regard that rotation of the composite gear 16 is limited to 180° in both modes of operation.

Furthermore, regardless of whether the turn knob 5 or the key operated lock 7 is used to move the deadbolt 9, the direction of rotation of the turn knob 5 or the lock 7 must be the reverse of that described above in order to transfer the deadbolt 9 from the operative position to the inoperative position.

Figure 6:
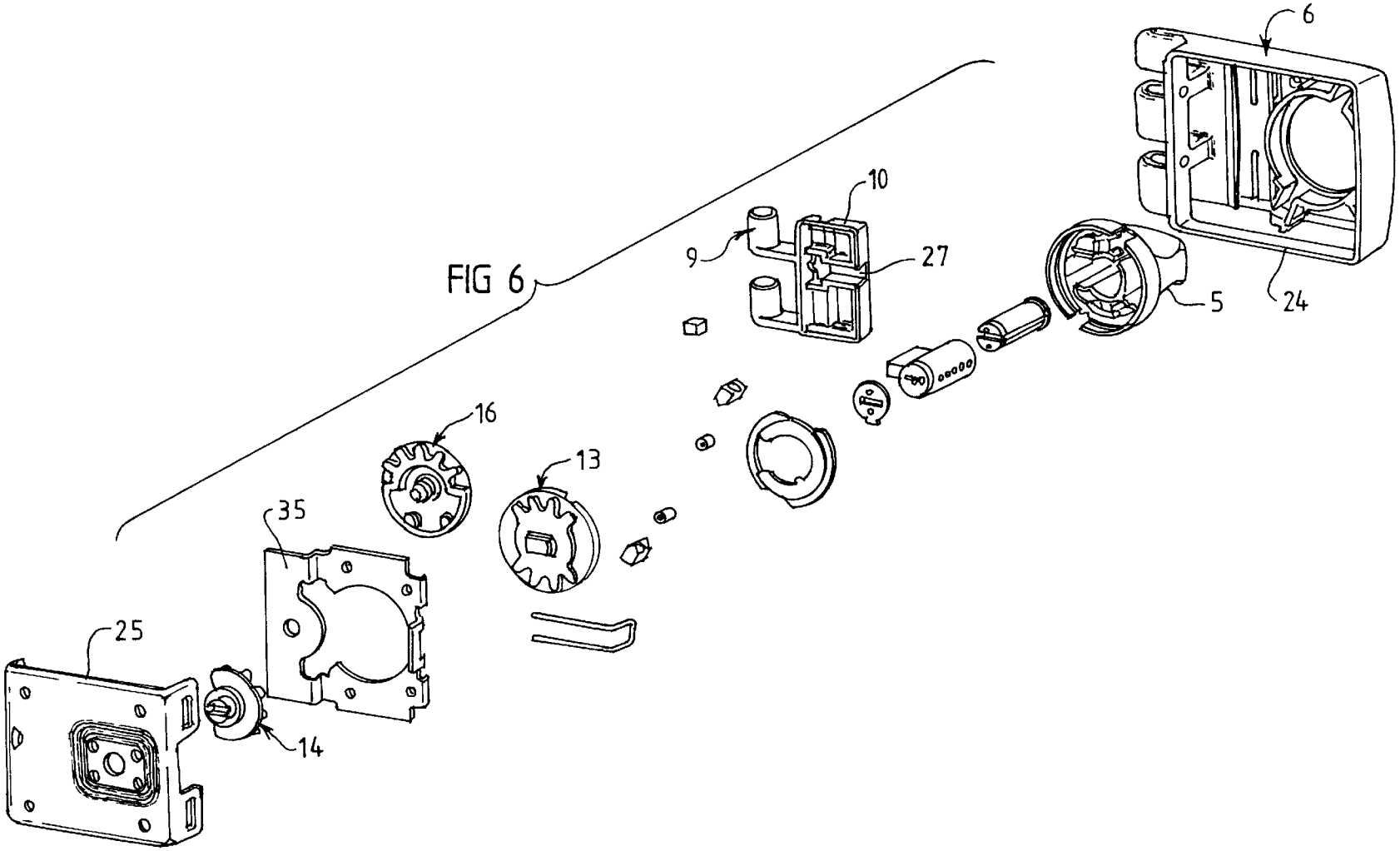
FIG. 6 is an exploded view of the lock mechanism of FIGS. 4 and 5.

FIG. 6 is an exploded view of the lock mechanism previously described. A mounting plate 35 as shown in that figure may be used to hold the gear 13 and the composite gear 16 in correct radial relationship and may form part of the sub-assembly initially loaded within the casing 6.

It will be apparent from the foregoing description that a lock mechanism according to the present invention provides a very simple and effective means of operating a deadbolt. The mechanism involves use of a minimum number of parts and can be assembled by automatic means.

Various alterations, modifications and/or additions may be introduced into the constructions and arrangements of parts previously described without departing from the spirit or ambit of the invention as defined by the appended claims.

What is claimed is:

1. A lock mechanism including, a deadbolt which is movable between an operative position and an inoperative position, first and second independently operable rotatable actuators, a gear train through which each said actuator is drivably connected to said deadbolt and which includes first and second drive gears and first and second driven gears, said first and second drive gears being arranged for relative rotation about a common axis and being drivably connected to said first and second actuators respectively, said driven gears forming respective parts of a rotatable composite gear, said first and second drive gears cooperating with said first and said second driven gears respectively so that said composite gear rotates in response to rotation of either said drive gear, drive means drivably connecting said composite gear to said deadbolt so that the deadbolt moves between said operative and inoperative positions in response to rotation of said composite gear, and said first and second drive gears cooperate with their respective driven gears in a manner such that said deadbolt moves from one said position to the other in response to 360° rotation of said first actuator and moves from one said position to the other in response to substantially less than 360° rotation of said second actuator.

2. A lock mechanism according to claim 1, wherein said deadbolt moves from one said position to the other in response to 180° rotation of said second actuator.

3. A lock mechanism according to claim 1, wherein said first and second drive gears are formed integral with one another.

4. A lock mechanism according to claim 1, wherein each said actuator is in a rest position when said deadbolt is in said inoperative position, and neither said drive gear cooperatively engages with its respective driven gear when the respective said actuator is in said rest position.

5. A lock mechanism according to claim 1, wherein said first drive gear is a partial gear having a series of gear teeth extending around part only of the circumference thereof.

6. A lock mechanism according to claim 1, wherein said second drive gear is a partial gear having two series of gear teeth which are spaced apart around the circumference of the gear and each of which extends around a respective part of said circumference.

7. A lock mechanism according to claim 1, wherein each said driven gear is a partial gear having a series of gear teeth extending around part only of the circumference thereof and having a non-toothed portion extending around the remainder of said circumference.

8. A lock mechanism according to claim 1, wherein said drive means includes a drive pin connected to said composite gear at a location radially outwards of the axis of rotation of said composite gear, and said drive pin extends outwards from a surface of said composite gear in a direction substantially parallel to the axis of rotation of said composite gear and cooperatively engages with said deadbolt so as to cause linear movement of the deadbolt between said positions thereof in response to rotary movement of said composite gear.

9. A lock mechanism according to claim 8, wherein said drive pin is slidably located within a slot formed in said deadbolt and which extends longitudinally in a direction transverse to the direction of movement of said deadbolt between said positions thereof.

10. A lock mechanism according to claim 1, wherein each said actuator is connected directly to its respective said drive gear.

11. A lock mechanism according to claim 1, wherein said gear train is located within a hollow casing and forms part of a sub-assembly which is movable into and out of said casing through a side thereof.

12. A lock mechanism according to claim 11, wherein said gear train is connected to a mounting plate which also forms part of said sub-assembly and which retains said drive gears in correct radial relationship with said driven gears.

13. A lock mechanism according to claim 11, wherein said gear train is attached to a cover plate which is releasably connected to said casing so as to close said casing side and retain said gear train within the casing.

14. A lock mechanism according to any one of claims 11, wherein said deadbolt is located within said casing and is guided by that casing for linear movement between said operative and inoperative positions.

15. A lock mechanism comprising, a deadbolt movable between an operative position and an inoperative position, first and second independently operable rotatable actuators, a gear train through which each said actuator is drivably connected to said deadbolt, said gear train including first and second drive gears and first and second driven gears, said first and second drive gears arranged for relative rotation about a common axis and being drivably connected to said first and second actuators respectively so that each rotates in response to operation of a respective one of said actuators, said first and second driven gears forming respective parts of a rotatable composite gear, said first and second drive gears cooperating with said first and said second driven gears respectively so that said composite gear rotates in response to operation of either one of said actuators with consequent rotation of the drive gear connected to the operative actuator, drive means drivably connecting said composite gear to said deadbolt so that said deadbolt moves between said operative and inoperative positions in response to rotation of said composite gear, and said first and second drive gears cooperate with their respective driven gears in a manner such that said deadbolt moves from one said position to the other in response to 360° rotation of said first actuator and moves from one said position to the other in response to substantially less than 360° rotation of said second actuator.

16. The lock mechanism according to claim 15, wherein said first drive gear is a partial gear having a series of gear teeth extending around only part of the circumference thereof.

17. The lock mechanism according to claim 15, wherein each said driven gear is a partial gear having a series of gear teeth extending around only part of the circumference thereof and having a non-toothed portion extending around the remainder of said circumference.

18. The lock mechanism according to claim 15, wherein said drive means includes a drive pin connected to said composite gear at a location radially outwards of an axis of rotation of said composite gear, and said drive pin extending outwards from a surface of said composite gear in a direction substantially parallel to said axis of rotation of said composite gear and cooperatively engages with said deadbolt so as to cause linear movement of said deadbolt between said positions in response to rotary movement of said composite gear.

19. The lock mechanism according to claim 15, wherein said drive pin is slidably located within a slot formed in said deadbolt and which extends longitudinally in a direction transverse to the direction of movement of said deadbolt between said positions.

* * * * *

UNITED STATES PATENT AND TRADEMARK OFFICE

CERTIFICATE OF CORRECTION

PATENT NO. : 6,374,650 B1
DATED : April 23, 2002
INVENTOR(S) : Donald John Newman It is certified that error appears in the above-identified patent and that said Letters Patent is hereby corrected as shown below:

Column 1,
Line 24, “actuator however” should read -- actuator, however --

Column 2,
Line 24, “the-invention” should read -- the invention --
Line 37, “of invention” should read -- of the invention --

Column 6,
Line 11, “any one of claims” should read -- claim --
Line 52, “extending” should read -- extends --
Line 59, “claim 15” should read -- claim 18 --

Signed and Sealed this

Eighth Day of June, 2004

JON W. DUDAS
*Acting Director of the United States Patent and Trademark Office*